US006174006B1

(12) United States Patent
Burt

(10) Patent No.: US 6,174,006 B1
(45) Date of Patent: Jan. 16, 2001

(54) TAMPER RESISTANT SEAL

(75) Inventor: David Austin Burt, Berkshire (GB)

(73) Assignee: Illinois Tool Works Inc., Glenview, IL (US)

( * ) Notice: Under 35 U.S.C. 154(b), the term of this patent shall be extended for 0 days.

(21) Appl. No.: 09/124,416

(22) Filed: Jul. 29, 1998

(30) Foreign Application Priority Data

Jul. 29, 1997 (GB) ..... 9716017

(51) Int. Cl.[7] ..... B65D 27/30

(52) U.S. Cl. ..... 292/307 A; 292/318; 292/321; 292/322; 292/307 R; 24/16 PB

(58) Field of Search ..... 292/307 A, 307 B, 292/307 R, 308, 311, 317, 318, 319, 321, 322, 323, 324; 24/671, 676, 16 PB, 30.5 P; 411/512

(56) References Cited

U.S. PATENT DOCUMENTS

| | | | | |
|---|---|---|---|---|
| Re. 31,541 | * | 3/1984 | Wood | 24/16 PB |
| 2,356,856 | * | 8/1944 | Komenak | 292/318 |
| 3,462,802 | * | 8/1969 | Merser | 292/322 |
| 3,830,538 | * | 8/1974 | Moberg | 292/322 |
| 3,975,040 | * | 8/1976 | Van Gompel | 292/318 |
| 4,001,919 | * | 1/1977 | Moberg et al. | 24/16 PB |
| 4,038,725 | * | 8/1977 | Keefe | 24/150 FP |
| 4,093,288 | * | 6/1978 | Suzuki | 292/321 |
| 4,125,917 | * | 11/1978 | Andre | 24/73 FT |
| 4,586,570 | * | 5/1986 | Swift | 169/75 |
| 4,908,911 | | 3/1990 | Bretti et al. | 24/16 PB |
| 5,123,913 | | 6/1992 | Wilk et al. | 606/232 |
| 5,208,948 | | 5/1993 | Nirei | 24/16 PB |
| 5,377,388 | * | 1/1995 | DeBever | 24/16 PB |
| 5,379,494 | | 1/1995 | Shirakawa | 24/168 PB |
| 5,459,907 | | 10/1995 | Nivet | 24/484 |
| 5,524,945 | | 6/1996 | Georgopoulos | 292/307 A |
| 5,568,952 | * | 10/1996 | Ruegg | 292/318 |

FOREIGN PATENT DOCUMENTS

| | | | | |
|---|---|---|---|---|
| 1216284 | * | 12/1970 | (GB) | 24/297 |

* cited by examiner

*Primary Examiner*—Darnell M. Boucher
*Assistant Examiner*—Clifford B. Vaterlaus
(74) *Attorney, Agent, or Firm*—Schwartz & Weinrieb

(57) ABSTRACT

A tamper resistant seal comprises a series of ratchet teeth (12) arranged along a strap (14), with one end of the strap (14) being secured to a body (16) and the other end of the strap (14) being insertable into the body (16) so as to move the ratchet teeth (12) sequentially past a resiliently deformable catch (18), wherein the resiliently deformable catch (18) includes a pair of opposed jaws (44) which are movable laterally primarily with a vise-like or spelling action rather than a collet-like or flexing action.

19 Claims, 1 Drawing Sheet

TAMPER RESISTANT SEAL

FIELD OF THE INVENTION

The present invention relates to a tamper resistant seal of the kind including a series of ratchet teeth arranged along a strap, with one end of the strap being secured to a body and the other end of the strap being insertable into the body so as to move the ratchet teeth sequentially past a resiliently deformable catch.

BACKGROUND OF THE INVENTION

It should not be possible to withdraw the strap from the body by moving the ratchet teeth in the reverse direction past the resiliently deformable catch.

As a result, when the tamper resistant seal is used in conjunction with a cash box, for example, it should not be possible to open the cash box without necessarily breaking or at least damaging the tamper resistant seal.

Typically, the ratchet teeth are of frusto-conical form and the resiliently deformable catch is formed from three fingers which extend longitudinally from a common circumferentially continuous base.

The fingers are flexed outwardly as a leading conical part of each ratchet tooth is moved therepast, and simultaneously snap inwardly as a trailing flat part of each ratchet tooth is moved therepast.

OBJECT OF THE INVENTION

An object of the present invention is to improve upon a typical tamper resistant seal particularly in terms of reducing the thickness of a typical tamper resistant seal.

SUMMARY OF THE INVENTION

According to the present invention, a tamper resistant seal of the kind hereinbefore defined is characterized in that the resiliently deformable catch includes a pair of opposed jaws which are movable laterally primarily with a vise-like or spreading action rather than a collet-like or flexing action.

It will be appreciated that by providing two jaws which move apart with a spreading action rather than three fingers which move apart with a flexing action as in a typical tamper resistant seal, the longitudinal dimension or thickness of the resiliently deformable catch can be considerably reduced in the tamper resistant seal of the present invention.

Preferably, the resiliently deformable catch is formed separately from the body and is of a substantially planar construction.

The resiliently deformable catch may have a peripheral wall spanned by a pair of parallel inner walls, with a central part of each of the inner walls being formed with a respective one of the jaws and, between the inner walls, the peripheral wall has V-shaped portions.

Preferably, the resiliently deformable catch is sandwiched between the body and a generally conical cap; the resiliently deformable catch, the body and the cap are all formed of plastic materials; and a free end of an initially cylindrical side wall of the body has been turned-in by heat-forming over the cap.

BRIEF DESCRIPTION OF THE DRAWINGS

A tamper resistant seal, in accordance with the present invention, will now be described in more detail, by way of example only, with reference to the accompanying drawings, in which like reference characters designate like or corresponding parts throughout the several views, and wherein.

DESCRIPTION OF THE PREFERRED EMBODIMENT

Figure 1:
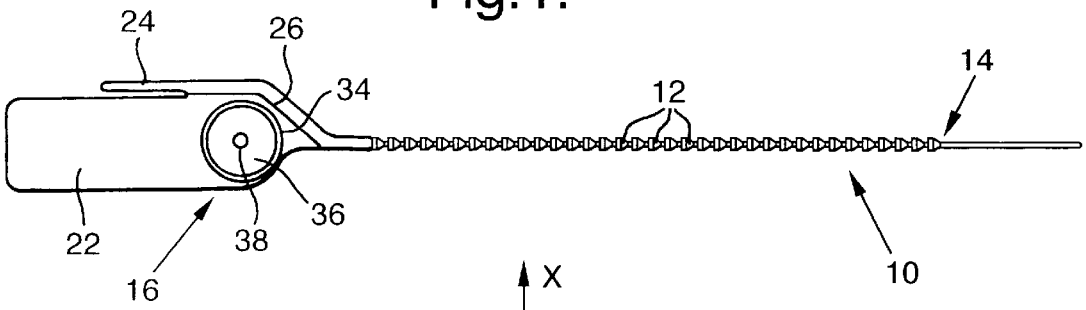
FIG. 1 is a plan view of the tamper resistant seal.

As shown in the accompanying drawings, a tamper resistant seal 10 includes a series of ratchet teeth 12 arranged along a strap 14, with one end of the strap 14 being secured to a body 16 and the other end of the strap 14 being insertable into the body 16 so as to move the ratchet teeth 12 sequentially past a resiliently deformable catch 18.

The body 16 has a housing 20, a flat tab 22 for carrying printed security information, and a tear-off strip 24 for enabling the strap 14 to be separated from the body 16 by pulling along a line of reduced thickness 26.

The housing 20 is formed with a bottom wall 28 and with a side wall 30. A central hole 32 is formed in the bottom wall 28. A free end 34 of the side wall 30 is initially cylindrical but during assembly of the tamper resistant seal 10, the free end 34 is turned-in by heat-forming over a cap 36. The cap 36, which is of generally conical form with a central hole 38, is pushed down by the free end 34 of the side wall 30 onto the resiliently deformable catch 18.

The resiliently deformable catch 18 is of a substantially planar construction and has a peripheral wall 40 spanned by a pair of parallel inner walls 42. A central part of each of the inner walls 42 is formed with a jaw 44 in the form of an upstanding protuberance which comes to a point at a curved upper end 46. Between the inner walls 42, the peripheral wall 40 has V-shaped portions 48 which facilitate tight assembly of the resiliently deformable catch 18 in the housing 20.

Each of the separate components is formed by molding of a plastic material in a conventional manner.

In use, the strap 14 is looped through or around a valuable to be protected, such as a cash box, and the free end of the strap 14 is then inserted into the hole 32 in the housing 20, past the jaws 44 of the resiliently deflectable catch 18 and out through the hole 38 in the cap 36.

Figure 2:
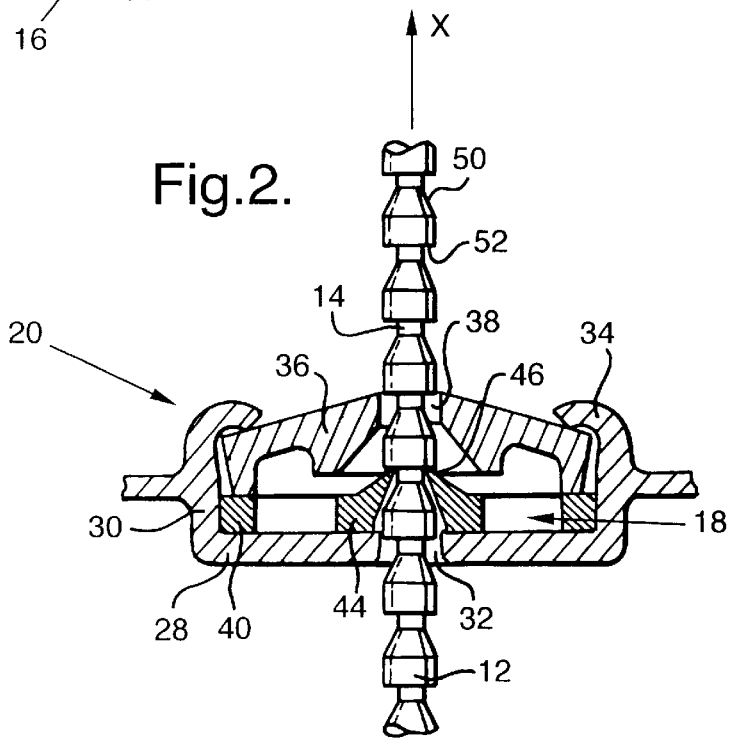
FIG. 2 is a fragmentary enlarged sectional view showing the tamper resistant seal in a locked configuration.
Figure 3:
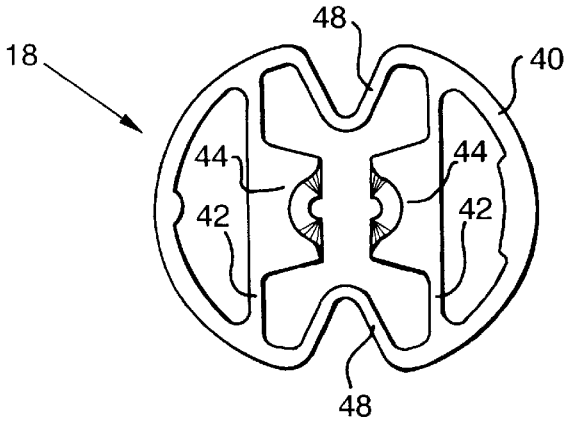
FIG. 3 is a bottom plan view, also enlarged, showing just one component of the tamper resistant seal.

As a ratchet tooth 12 is moved between the jaws 44, in the direction of the arrow X in FIG. 2, a conical leading part 50 of the ratchet tooth 12 acts as a wedge. This forces the curved upper ends 46 of the jaws 44 to be spread laterally apart from one another against the inherent resiliency of the inner walls 42 of the resiliently deformable catch 18. When a flat trailing part 52 of the ratchet tooth 12 has cleared the jaws 44, the curved upper ends 46 spring back towards one another and the strap 14 below the trailing part 52 of the ratchet tooth 12.

Clearly, pulling the strap 14 in the direction X will cause the tamper resistant seal 10 to tighten, whereas pulling the strap 14 in the reverse direction will be prevented because of the abutment of the trailing part 52 of the ratchet tooth 12 with the jaws 44 of the resiliently deformable catch 18. Obviously, many modifications and variations of the present invention are possible in light of the above teachings. It is therefore to be understood that within the scope of the appended claims, the present invention may be practiced otherwise than as specifically described herein.

I claim:

1. A tamper resistant seal for disposition around an object, comprising:

a body member having an internal peripheral housing portion;

a resiliently deformable catch, having a substantially planar configuration, disposed within said body member; and a strap having a series of ratchet teeth arranged along said strap, wherein one end of said strap is secured to said body member while an opposite end of said strap is insertable into said body member such that said series of ratchet teeth are able to sequentially move in a first direction past said resiliently deformable catch disposed within said body member;

wherein further, said resiliently deformable catch comprises a peripheral portion engaged with said internal peripheral portion of said body member, and a pair of opposed jaws which are mounted upon support members which are connected to first sections of said peripheral portion of said resiliently deformable catch but which are spaced from second sections of said peripheral portion of said resiliently deformable catch such that spaces are defined between said support members and said second sections of said peripheral portion of said resiliently deformable catch such that said pair of opposed jaws are able to move laterally away from each other, into said spaces defined between said support members and said second sections of said peripheral portion of said resiliently deformable catch, and toward said second sections of said peripheral portion of said resiliently deformable catch, substantially within the plane of said substantially planar resiliently deformable catch, as well as toward each other, so as to respectively permit said ratchet teeth to move sequentially past said pair of opposed jaws in said first direction when said strap is to be adjustably tightened around an object, and to prevent movement of said ratchet teeth in a second opposite direction with respect to said pair of opposed jaws so as to retain said strap in its adjustably tightened mode about an object.

2. A tamper resistant seal according to claim 1, wherein the resiliently deformable catch is formed separately from the body.

3. A tamper resistant seal according to claim 1, wherein:

said support members comprise a pair of parallel inner walls spanning said peripheral portion of said resiliently deformable catch, with a central part of each one of said inner walls having a respective one of said jaws disposed thereon at positions located between said inner walls; and said peripheral portion of said resiliently deformable catch is provided with expandible/contractible resilient V-shaped portions for maintaining said resiliently deformable catch tightly disposed within said body member.

4. A tamper resistant seal according to claim 1, wherein the resiliently deformable catch is sandwiched between the body member and a generally conical cap.

5. A tamper resistant seal according to claim 4, wherein the resiliently deformable catch, the body member and the cap are all formed of plastic materials.

6. A tamper resistant seal according to claim 5, wherein:

said body member comprises an upstanding cylindrical side wall; and a free end of said upstanding cylindrical side wall of said body member is deformed radially inwardly so as to overlap said cap and thereby retain said cap and said resiliently deformable catch within said body member.

7. The tamper resistant seal as set forth in claim 1, wherein:

said pair of opposed jaws of said resiliently deformable catch define a space therebetween through which said series of ratchet teeth can sequentially pass; and said body member comprises a bottom wall member having an aperture defined therein which is coaxially aligned with said space defined between said pair of opposed jaws of said resiliently deformable catch so as to permit said opposite end of said strap to be inserted through said body member and past said pair of opposed jaws.

8. The tamper resistant seal as set forth in claim 7, further comprising:

a cap member fixedly mounted within said body member so as to sandwich said resiliently deformable catch between said bottom wall member of said body member and said cap member.

9. The tamper resistant seal as set forth in claim 8, wherein:

said cap member has an aperture defined therein which is coaxially aligned with said space, defined between said pair of opposed jaws of said resiliently deformable catch, and said aperture defined within said bottom wall member of said body member.

10. The tamper resistant seal as set forth in claim 1, wherein:

each one of said ratchet teeth comprises a leading portion having a substantially frusto-conical configuration so as to radially expand said pair of opposed jaws away from each other, and a trailing portion having a substantially flat, radially disposed surface for engaging said pair of opposed jaws so as to prevent movement of said strap in said second direction with respect to said resiliently deformable catch and said body member.

11. A tamper resistant bundling tie for disposition around an object, comprising:

a body member having an internal peripheral housing portion;

a resiliently deformable catch, having a substantially planar configuration, disposed within said body member; and a strap having a series of ratchet teeth disposed along said strap, wherein one end of said strap is secured to said body member while an opposite end of said strap is insertable into said body member such that said series of ratchet teeth are able to sequentially move in a first direction past said resiliently deformable catch disposed within said body member;

wherein further, said resiliently deformable catch comprises a peripheral portion engaged with said internal peripheral portion of said body member, and a pair of opposed jaws which are mounted upon support members which are connected to first sections of said peripheral portion of said resiliently deformable catch but which are spaced from second sections of said peripheral portion of said resiliently deformable catch such that spaces are defined between said support members and said second sections of said peripheral portion of said resiliently deformable catch such that said pair of opposed jaws are able to move laterally away from each other, into said spaces defined between said support members and said second sections of said peripheral portion of said resiliently deformable catch, and toward said second sections of said peripheral portion of said resiliently deformable catch, substantially within the plane of said substantially planar resiliently deformable catch, as well as toward each other, so as to respectively permit said ratchet teeth to move sequentially past said pair of opposed jaws in said first direction when said strap is to be adjustably tightened around an object, and to prevent movement of said ratchet teeth in a second opposite direction with respect to said pair of opposed jaws so as to retain said strap in its adjustably tightened mode about an object.

12. A tamper resistant bundling tie as set forth in claim 11, wherein:

said support members comprise a pair of parallel inner walls spanning said peripheral portion of said resiliently deformable catch, with a central part of each one of said inner walls having a respective one of said jaws disposed thereon at positions located between said inner walls; and said peripheral portion of said resiliently deformable catch is provided with expandible/contractible resilient V-shaped portions for maintaining said resiliently deformable catch tightly disposed within said body member.

13. A tamper resistant bundling tie as set forth in claim 11, wherein:

said pair of opposed jaws of said resiliently deformable catch define a space therebetween through which said series of ratchet teeth can sequentially pass; and said body member comprises a bottom wall member having an aperture defined therein which is coaxially aligned with said space defined between said pair of opposed jaws of said resiliently deformable catch so as to permit said opposite end of said strap to be inserted through said body member and past said pair of opposed jaws.

14. The tamper resistant seal as set forth in claim 13, further comprising:

a cap member fixedly mounted within said body member so as to sandwich said resiliently deformable catch between said bottom wall member of said body member and said cap member.

15. The tamper resistant seal as set forth in claim 14, wherein:

said cap member has an aperture defined therein which is coaxially aligned with said space, defined between said pair of opposed jaws of said resiliently deformable catch, and said aperture defined within said bottom wall member of said body member.

16. The tamper resistant seal as set forth in claim 11, wherein:

each one of said ratchet teeth comprises a leading portion having a substantially frusto-conical configuration so as to radially expand said pair of opposed jaws away from each other, and a trailing portion having a substantially flat, radially disposed surface for engaging said pair of opposed jaws so as to prevent movement of said strap in said second direction with respect to said resiliently deformable catch and said body member.

17. A tamper resistant bundling tie as set forth in claim 14, wherein:

said body member, said resiliently deformable catch, and said cap member are all formed from a plastic material.

18. A tamper resistant bundling tie as set forth in claim 14, wherein:

said body member comprises an upstanding cylindrical side wall; and a free end of said upstanding cylindrical side wall of said body member is deformed radially inwardly so as to overlap said cap member and thereby retain said cap member and said resiliently deformable catch within said body member.

19. A tamper resistant bundling tie as set forth in claim 11, wherein:

said resiliently deformable catch comprises a separate and independent component with respect to said body member.

* * * * *